United States Patent [19]

Bonnecaze

[11] 4,401,436

[45] Aug. 30, 1983

[54] PROCESS FOR COOLING PARTICULATE COAL

[75] Inventor: Bernard F. Bonnecaze, Littleton, Colo.

[73] Assignee: Atlantic Richfield Company, Los Angeles, Calif.

[21] Appl. No.: 333,145

[22] Filed: Dec. 21, 1981

[51] Int. Cl.[3] ..... C10L 5/30

[52] U.S. Cl. ..... 44/1 G; 34/13

[58] Field of Search ..... 44/6, 1 R, 1 G, 2; 34/13, 57 R, 66; 110/245; 432/13, 85, 198

[56] References Cited

U.S. PATENT DOCUMENTS

| | | | |
|---|---|---|---|
| 3,250,016 | 5/1966 | Agarwal | 34/57 R |
| 3,723,079 | 3/1973 | Seitzer | 44/1 R |

*Primary Examiner*—Carl F. Dees

*Attorney, Agent, or Firm*—F. Lindsey Scott

[57] ABSTRACT

In a process for drying particulate coal by passing a heated gas through the particulate coal in a heating zone and thereafter cooling the dried particulate coal in a cooling zone, an improvement comprising the addition of a controlled quantity of water to the dried coal in the cooling zone so that the coal is cooled by evaporation of the water.

9 Claims, 5 Drawing Figures

PROCESS FOR COOLING PARTICULATE COAL

This invention relates to methods for producing a dried particulate coal fuel having a reduced tendency to spontaneously ignite from a particulate low rank coal.

This invention further relates to an improved method for cooling dried particulate low rank coal.

In many instances, coal as mined contains undesirably high quantities of water for transportation and use as a fuel. This problem is common to all coals, although in higher grade coals, such as anthracite and bituminous coals, the problem is less severe because the water content of the coal is normally lower and the heating value of such coals is higher. The situation is different with respect to lower grade coals such as sub-bituminous, lignite and brown coals. Such coals, as produced, typically contain from about 25 to about 65 weight percent water. While such coals are desirable as fuels because of their relatively low mining cost and since many such coals have a relatively low sulfur content, the use of such lower grade coals as fuel has been greatly inhibited by the fact that as produced, they typically contain a relatively high percentage of water. Attempts to dry such coals for use as a fuel have been inhibited by the tendency of such coals after drying to undergo spontaneous ignition and combustion in storage, transit or the like.

The drying required with such low rank coals is a deep drying process for the removal of surface water plus the large quantities of interstitial water present in such low rank coals. By contrast, when higher grade coals are dried, the drying is commonly for the purpose of drying the surface water from the coal particle surfaces but not interstitial water, since the interstitial water content of the higher rank coals is relatively low. As a result, short residence times in the drying zone are normally used, and the interior portions of the coal particles are not heated, since such is not necessary for surface drying. Typically, the coal leaving the dryer in such surface water drying processes is at a temperature below about 110° F. (45° C.). By contrast, processes for the removal of interstitial water require longer residence times and result in heating the interior portions of the coal particles. The coal leaving a drying process for the removal of interstitial water will typically be at a temperature from about 130° to about 250° F. (54° to 121° C.). When such processes for the removal of interstitial water are applied to low rank coals, the resulting dried coal has a strong tendency to spontaneously ignite, especially at the high discharge temperatures, upon storage, during transportation and the like.

As a result, a continuing effort has been directed to the development of improved methods whereby such lower grade coals can be dried and thereafter safely transported, stored and used as fuels.

It has now been found that such coals are readily dried to produce a stable, storable dried coal product by a method comprising:

a. charging the particulate low rank coal to a coal drying zone;

b. drying the particulate low rank coal in the coal drying zone to produce a dried coal;

c. recovering the dried coal from the coal drying zone;

d. charging the dried coal to a coal cooling zone;

e. cooling the dried coal to a temperature below about 100° F. (38° C.).

An improvement is accomplished in the process by spraying a controlled amount of water onto the dried coal in the coal drying zone, the water being sprayed onto the dried coal in an amount sufficient to remove a desired quantity of heat from the dried coal upon evaporation of the water.

The dried coal may be partially oxidized prior to cooling.

In some instances, it is desirable that the cooled dried coal product be further deactivated by mixing the dried particulate coal product with a suitable deactivating fluid.

In the description of the Figures, the same numbers will be used to refer to the same or similar components throughout. Further, it should be noted that in the description of the Figures, reference will be made to lines generally rather than attempting to distinguish between lines as conduits, conveyors or the like as required for the handling of particulate solid materials.

Figure 1:
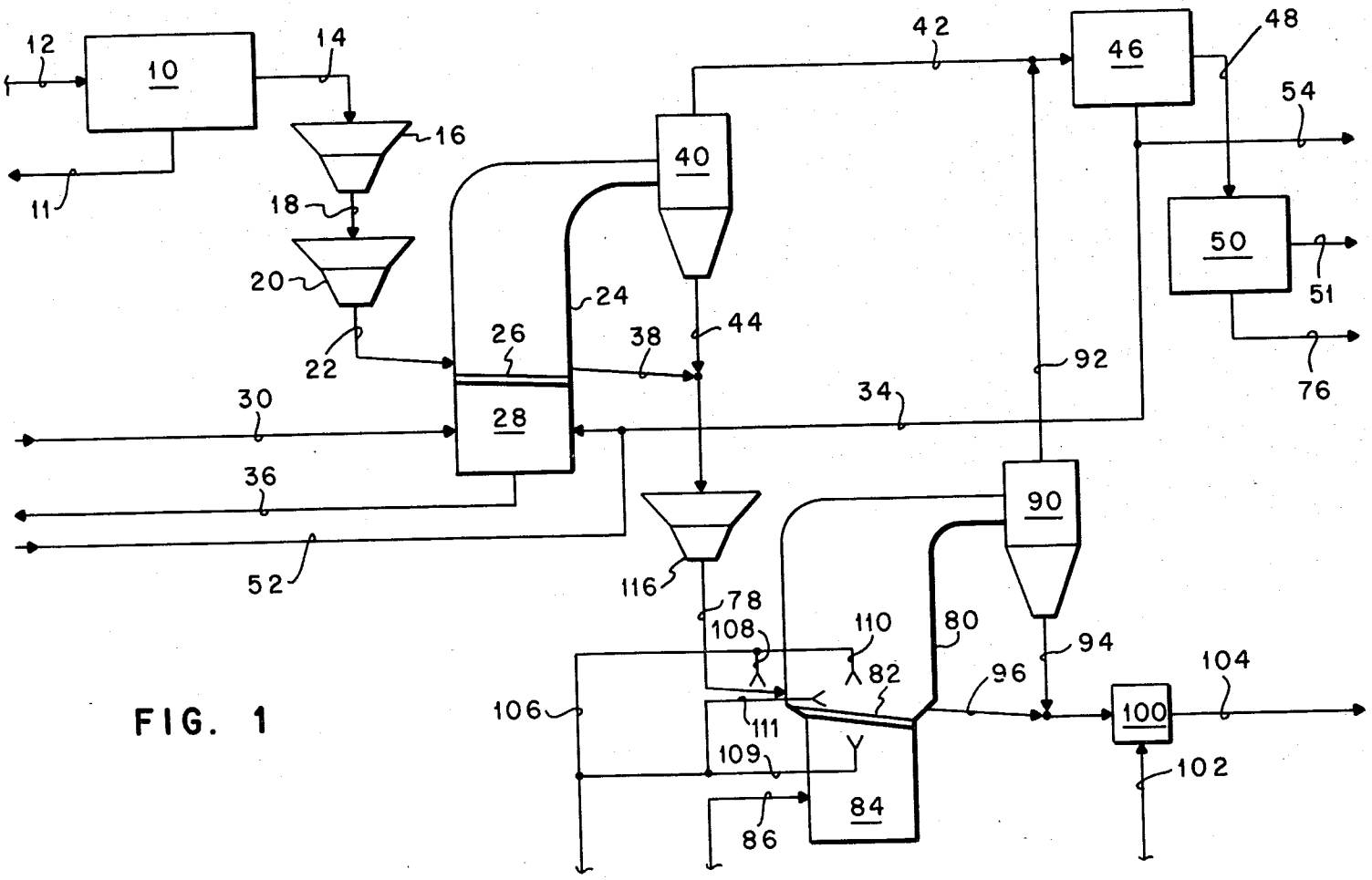
FIG. 1 is a schematic diagram of an embodiment of a process in conjunction with which the improvement of the present invention is useful.

In FIG. 1, a run of mine coal stream is charged through a line 12 to a coal cleaning or preparation plant 10 from which a coal stream is recovered through a line 14 with a waste stream comprising gangues and the like being recovered and passed to discharge through a line 11. In some instances, it may not be necessary to pass the run of mine coal to a coal cleaning or processing plant prior to charging it to the process. The coal stream recovered from preparation plant 10 through line 14 is passed to a crusher 16 where it is crushed to a suitable size and passed through a line 18 to a hopper 20. While a size consist less than about two inches, i.e. two inches by zero may be suitable in some instances, typically a size consist of about one inch by zero or about three-quarters inch by zero will be found more suitable. The particulate coal in hopper 20 is fed through a line 22 into a dryer 24. In dryer 24, the coal moves across dryer 24 above a grate 26 at a rate determined by the desired residence time in dryer 24. A hot gas is passed upwardly through the coal moving across grate 26 to dry the coal. The hot gas is produced in FIG. 1 by injecting air through a line 30 to combust a stream of coal fines injected through a line 34. The combustion of the coal fines generates a hot gas at a temperature suitable for drying the coal. As will be obvious to those skilled in the art, the temperature can be varied by diluting the air with a noncombustible gas, by the use of alternate fuels or the like. Clearly, alternate fuels, i.e. liquid or gaseous fuels could be used instead of or in addition to the finely divided coal, although it is contemplated that in most instances, a stream of finely divided coal will be found most suitable for use as a fuel to produce the heated gas. Ash is recovered from dryer 24 through a line 36. In FIG. 1, a combustion zone 28 is provided beneath grate 26 to permit the production of the hot gas in dryer 24, although it will be readily understood that the hot gas could be produced outside dryer 24 or the like. The exhaust gas from dryer 24 is passed to a cyclone 40 where finely divided solids, typically larger than about 100 Tyler mesh, are separated from the exhaust gas and recovered through a line 44. The exhaust gas, which may still contain solids smaller than about 100 Tyler mesh, is passed through a line 42 to a fine solids recovery section 46 where finely divided solids, which will typically consist primarily of finely divided coal are recovered through a line 34 with all or a portion of the finely divided coal being recycled back to combustion zone 28. The purified exhaust gas from fine solids recovery section 46 is passed through a line 48 to a gas cleanup section 50 where sulfur compounds, light hydrocarbon compounds, and the like are removed from the exhaust gas in line 48, as necessary to produce a flue gas which can be discharged to the atmosphere. The purified gas is discharged via a line 51 with the contaminates recovered from the exhaust gas being recovered through a line 76 and optionally passed to a flare, a wet scrubber, or the like. The handling of the process gas discharge is not considered to constitute a part of the present invention, and the cleanup of this gaseous stream will not be discussed further. The fine coal stream recovered through line 34 may in some instances constitute more coal fines than are usable in combustion zone 28. In such instances, a fine coal product can be recovered through line 54. In other instances, the amount of coal fines recovered may not be sufficient to provide the desired temperature in the hot gas used in dryer 24. In such instances, additional coal fines may be added through a line 52.

The dried coal product recovered from dryer 24 is recovered via a line 38 and combined with the solids recovered from cyclone 40 through line 44 and passed to a hopper 116 from which dried coal is fed via a line 78 to a cooler 80. In cooler 80, the dried coal moves across cooler 80 above a grate 82. A cool gas is introduced through a line 86 into a distribution chamber 84 beneath grate 82 and passed upwardly through the dried coal to cool the dried coal. The upper portion of cooler 80 above grate 82 is desirably larger in cross-section than grate 82. The exhaust gas from cooler 80 is passed to a cyclone 90 where solids generally larger than about 100 Tyler mesh are separated and recovered through a line 94 with the exhaust gas being passed through a line 92 to fine solids recovery section 46. Optionally, the gas recovered through line 92 could be passed to combustion chamber 28 for use in producing the hot gas required in dryer 24. The cooled dried coal is recovered through a line 96 and combined with the solids recovered from cyclone 90 to produce a dried coal product. The tendency of such dried low rank coals to spontaneously ignite is inhibited greatly by cooling such coals after drying. In some instances, no further treatment may be necessary to produce a dried coal product which does not have an undue tendency to spontaneously ignite upon transportation and storage. In other instances, it will be necessary to treat the dried coal product further. In such instances, the dried coal product may be coated with a suitable deactivating fluid in a mixing zone 100. The deactivating fluid is introduced through a line 102 and intimately mixed with the cooled dried coal in mixing zone 100 to produce a coal product recovered through a line 104 which is not subject to spontaneous ignition under normal storage and transportation conditions. While the dried coal is mixed with deactivating fluid after cooling in FIG. 1, it should be understood that the dried coal can be mixed with the deactivating fluid at higher temperatures before cooling, although it is believed that normally the mixing is preferably at temperatures no higher than about 200° F. (93° C.).

In the operation of dryer 24, the discharge temperature of the dried coal is typically from about 130° to about 250° F. (54° to 121° C.) and is preferably from about 190° to about 220° F. (88° to 104° C.). The hot gas is passed upwardly through the coal on grate 26 at a suitable rate to maintain the coal in a fluidized or semi-fluidized condition above grate 26. The residence time is chosen to accomplish the desired amount of drying and is readily determined experimentally by those skilled in the art based upon the particular type of coal used and the like. For instance, when drying sub-bituminous coal, an initial water content of about 30 weight percent is common. Desirably, such coals are dried to a water content of less than about 15 weight percent and preferably from about 5 to about 10 weight percent. Lignite coals often contain in the vicinity of about 40 weight percent water and are desirably dried to less than about 20 weight percent water with a range from about 5 to about 20 weight percent water being preferred. Brown coals may contain as much as, or in some instances even more than about 65 weight percent water. In many instances, it may be necessary to treat such brown coals by other physical separation processes to remove portions of the water before drying is attempted. In any event, these coals are desirably dried to a water content of less than about 30 weight percent and preferably to about 5 to 20 weight percent. The determination of the residence time for such coals in dryer 24 may be determined experimentally by those skilled in the art for each particular coal. The determination of a suitable residence time is dependent upon many variables and will not be discussed in detail. The water contents referred to herein are determined by ASTM D3173-73 entitled "Standard Test Method for Moisture in the Analysis Sample of Coal and Coke", published in the 1978 Annual Book of ASTM Standards, Part 26. The discharge temperature of the dried coal from dryer 24 is readily controlled by varying the amount of coal fines and air injected into dryer 24 so that the resulting hot gaseous mixture after combustion is at the desired temperature. Temperatures beneath grate 26 should be controlled to avoid initiating spontaneous combustion of the coal on grate 26. Suitable temperatures for many coals are from 250° to about 950° F. (104° to 510° C.).

In the operation of cooler 80, the temperature of the dried coal charged to cooler 80 in the process shown in FIG. 1 is typically that of the dried coal discharged from dryer 24 less process heat losses. The temperature of the dried coal is desirably reduced in cooler 80 to a temperature below about 100° F. (38° C.) and preferably below about 80° F. (27° C.). The cool gas is passed upwardly through the coal on grate 82 at a suitable rate to maintain the coal in a fluidized or semi-fluidized condition about grate 82. The residence time, amount of cooling air, and the like may be determined experimentally by those skilled in the art. Such determinations are dependent upon the amount of cooling required, and the like. As well known to those skilled in the art, after drying, lower rank coals are very susceptible to spontaneous ignition and combustion upon storage, in transit or the like. While such is the case, it is highly desirable that such coals be available for use more widely than is possible at the present. The high moisture content of these fuels results in excessive shipping costs, due at least in large measure to the excessive amount of water which is subject to freight charges and similarly results in lower heating values for the coals since a substantial portion of the coal is water rather than combustible carbonaceous material. The lower heating value results in a limited use for the coals since many furnaces are not adapted to burn such lower heating value coals. By contrast, when the water content is reduced, the heating value is raised since a much larger portion of the coal then comprises combustible carbonaceous material. As a result, it is highly desirable that such coals be dried prior to shipment.

In many instances, it has been found that cooling such dried coals to a temperature below about 100° F. (38 ° C.), and preferably below about 80° F. (27° C.), is sufficient to inhibit spontaneous ignition of the dried coal. While Applicant does not wish to be bound by any particular theory, it appears that when such dried coal is cooled, the rate of oxidation is slowed to a rate such that the oxidation proceeds without raising the temperature of the coal to an ignition temperature before the reactivity of the coal is reduced by partial oxidation. Not all dried low rank coals will be found to be sufficiently non-reactive to permit storage and transportation without further treatment after cooling, but in many instances, such dried low rank coals are sufficiently nonreactive after cooling that spontaneous ignition is avoided. It has been observed that spontaneous ignition of such dried low rank coals is further inhibitied by the use of a suitable deactivating fluid to further reduce the tendency of the dried coal to spontaneously ignite as discussed more fully hereinafter. The deactivating fluid is desirably applied by intimately mixing it with the dried coal to produce a dried coal product having a reduced tendency toward spontaneous combustion. The use of the deactivating fluid also reduces the dusting tendencies of the coal.

Figure 2:
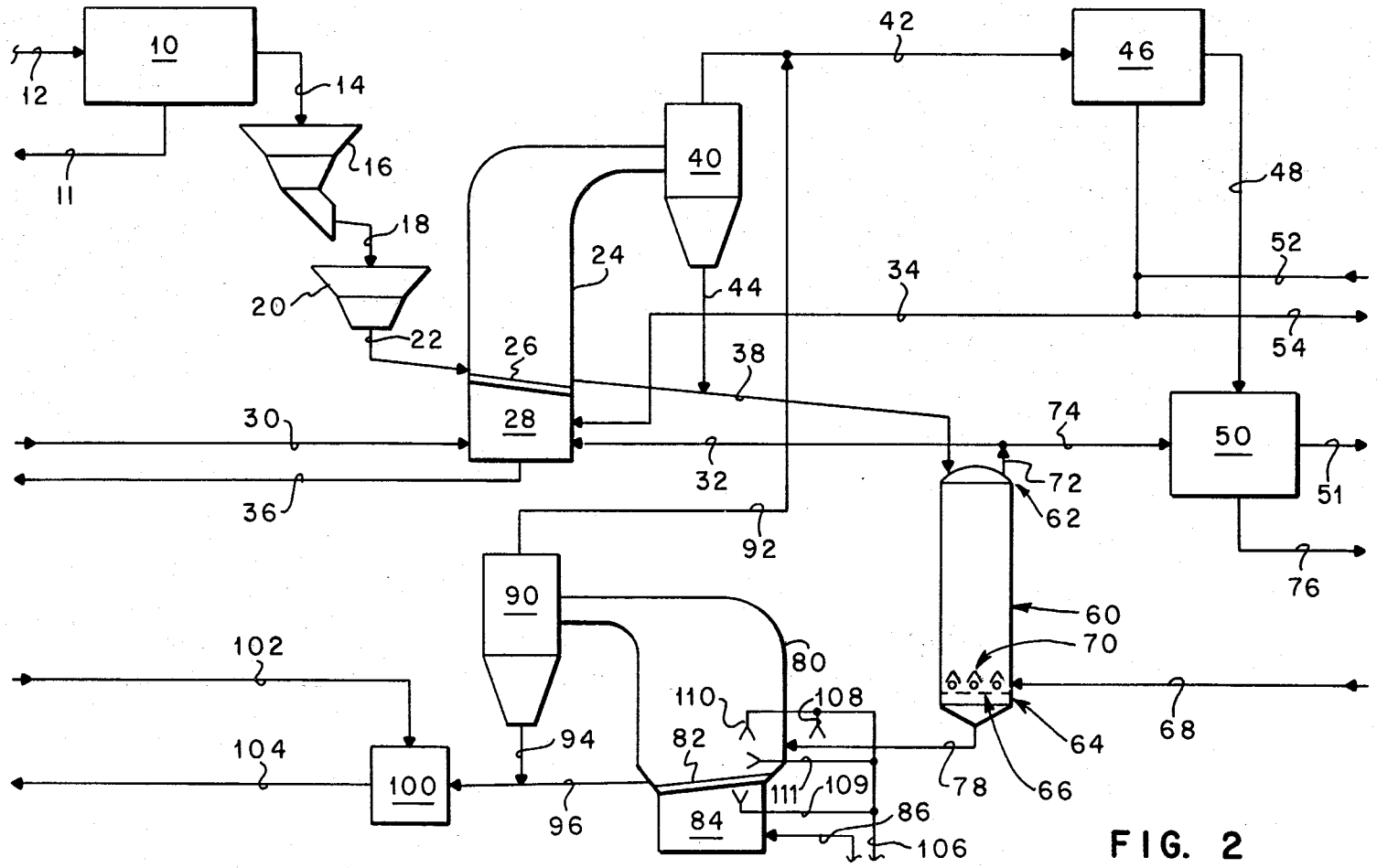
FIG. 2 is a schematic diagram of a further embodiment of a process in conjunction with which the improvement of the present invention is useful.

A further method for reducing the tendency of the dried coal to spontaneously ignite is the use of a controlled oxidation step after the coal drying operation and prior to cooling the dried coal. Such a variation is shown in FIG. 2 where the dried coal is passed through line 38 to a coal oxidizer vessel 60. The dried coal is charged to oxidizer 60 and passes downwardly through oxidizer 60 from its upper end 62 to its lower end 64 at a rate controlled to obtain the desired residence time. The flow of dried coal downwardly through oxidizer 60 is controlled by a grate 66 which supports the coal in oxidizer 60 and accomplishes the removal of controlled amounts of dried oxidized coal through line 78. Air is injected into oxidizer 60 through a line 68 and an air distribution system 70 as shown more fully in FIG. 3. Air distribution system 70 comprises a plurality of lines 122 having suitable openings (not shown) positioned along their length for the discharge of air into oxidizer 60 with lines 122 being positioned beneath shields 120. Shields 120 serve to prevent clogging of the air discharge openings in lines 122 and to prevent damage to lines 122 by the downcoming coal. Spaces 124 between shields 120 are provided for the passage of coal between shields 120 and the spaces 124 are typically sized to be at least three times the diameter of the largest coal particles expected in width. Oxidizer 60 also includes a coal distribution system 112 which may be of a variety of configurations known to those skilled in the art for the uniform distribution of particulate solids. Exhaust gases are recovered from oxidizer 60 through a line 72 and as shown in FIG. 2 and passed to gas cleanup section 50 for processing prior to discharge. Grate 66 may also be of a variety of configurations known to those skilled in the art for supporting and removing controlled amounts of a particulate solids stream passing downwardly through a reaction zone to result in uniform movement of particulate solids downwardly through the reaction zone. One such suitable grate is shown in U.S. Pat. No. 3,401,922 issued Sept. 17, 1968 to J. B. Jones, Jr. which is hereby incorporated in its entirety by reference.

Figure 3:
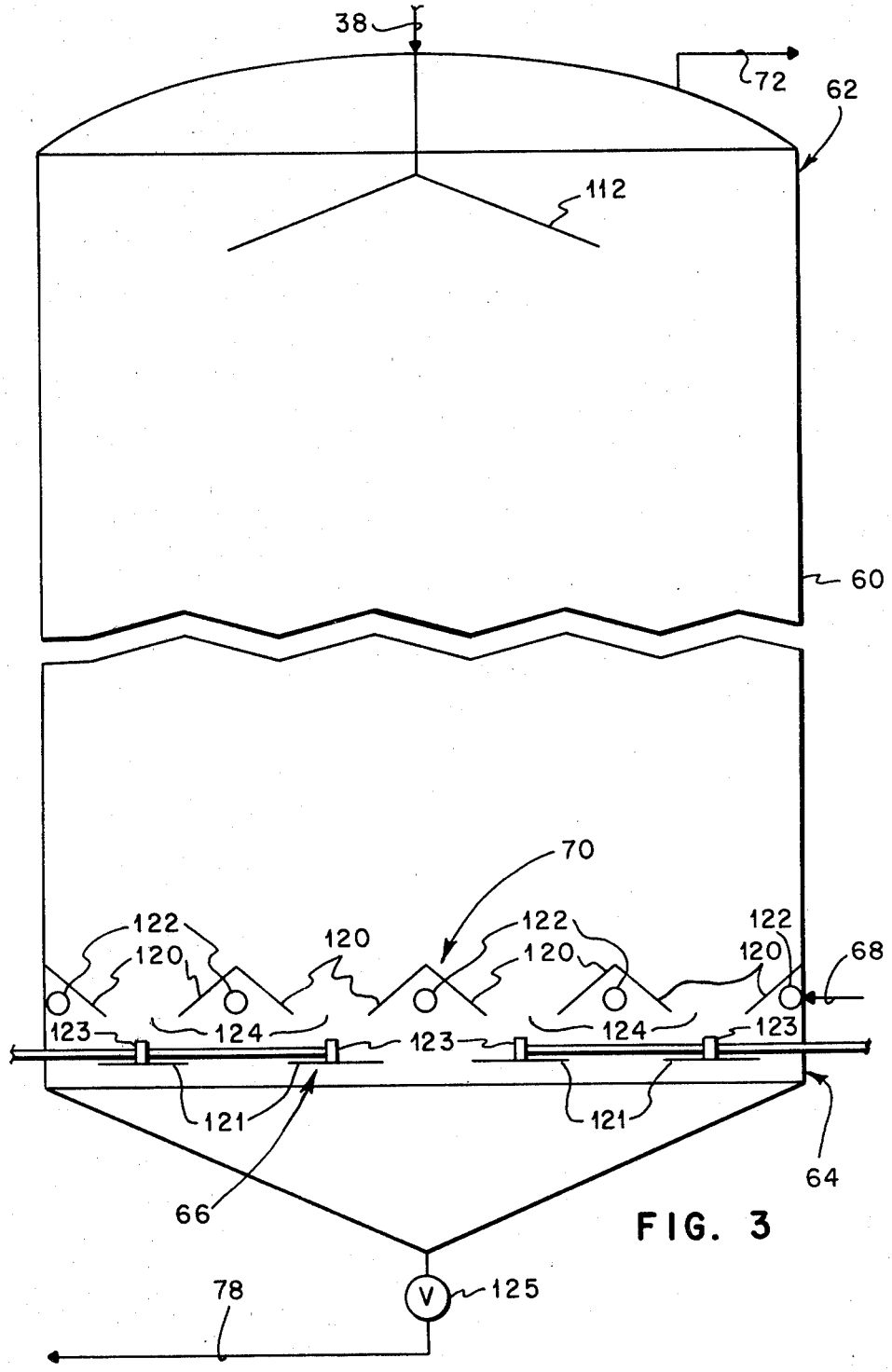
FIG. 3 is a schematic diagram of an oxidizer vessel suitable for use in the practice of the improvement of the present invention.

The grate shown in FIG. 3 is of the type disclosed in U.S. Pat. No. 3,401,922 and comprises retarder plates 121 positioned across the bottom of oxidizer 60 and pusher bars 123 to remove desired quantities of dried oxidized coal while supporting dried coal in oxidizer 60. Diverter plates are shown as shields 120 for air injection lines 122. A star feeder or the like 125 is included in line 78 to prevent the flow of air through line 78 as the dried oxidized coal is withdrawn. The operation of the grate shown is described in U.S. Pat. No. 3,401,922 which has been incorporated by reference. Air could be injected at a higher point in oxidizer 60 or at a plurality of points, but it is presently preferred that substantially all the air be injected near the bottom of oxidizer 60.

The oxidization of the dried coal in oxidizer 60 results in a further reduction in the tendency of the dried coal to spontaneously ignite. The dried oxidized coal is cooled in cooler 80 as described in conjunction with FIG. 1 and may be usable as a stable product without the need for mixing with a deactivating fluid. A method and apparatus for oxidizing such coal is set forth in U.S. patent application, Ser. No. 333,143 entitled "Method and Apparatus for Oxidizing Dried Low Rank Coal" filed of even date herewith by Donald K. Wunderlich.

In the oxidation of the dried coal in oxidizer 60, a continuing problem is the tendency for the coal to become progressively hotter as it oxidizes. It is desirable that from about 6 to about 25 lbs. of oxygen per ton of dried coal be used. A preferred range is from about 6 to about 15 lbs. of oxygen per ton of dried coal. The use of such amounts of oxygen results in the liberation of substantial quantities of heat. To maintain temperature stability in oxidizer 60, it has been found desirable to restrict the drying in dryer 24 to somewhat less than is desired in the final dried coal product. In other words, less drying is accomplished in dryer 24 than is desired in the dried oxidized coal product. In many instances, it will be desirable to leave from about 1 to about 5 weight percent water above that amount of water desired in the final dried oxidized product in the dried coal stream when it is to be oxidized. The presence of the additional water results in cooling the dried coal during oxidization by evaporation of the water. The amount of water left in contemplation of the oxidization step is desirably the amount required to remove the heat generated by the desired oxidization by evaporation. In most instances, it will be found desirable to leave from about 1 to about 3 weight percent water above that amount required in the dried product in the dried coal stream passed to oxidizer 60 when from 6 to about 15 lbs. of oxygen per ton of coal is used.

The dried oxidized product recovered from cooler 80 in many instances will be usable as a dried coal product as recovered. In other instances, it may be desirable that a suitable deactivating fluid be mixed with the dried oxidized coal product either before or after cooling the dried oxidized coal to produce a stable storable fuel.

Figure 4:
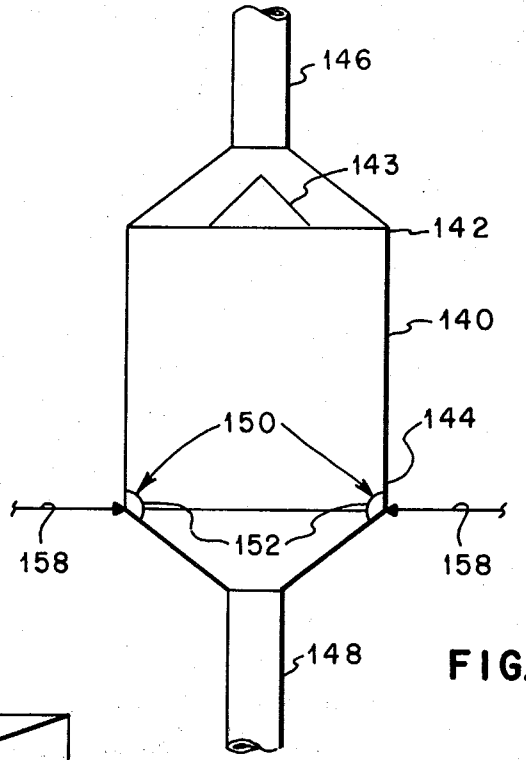
FIG. 4 is a schematic diagram of an apparatus suitable for use in intimately contacting particulate coal and a deactivating fluid; and, FIG. 5 is a schematic diagram of a further embodiment of an apparatus suitable for use in contacting particulate coal and a deactivating fluid.

The intimate mixing of the dried coal and deactivating fluid is readily accomplished in a vessel such as shown in FIG. 4. Such a vessel and a method for intimately contacting particulate coal and a deactivating fluid are set forth in U.S. patent application, Ser. No. 333,144 entitled "Method and Apparatus for Contacting Particulate Coal and a Deactivating Fluid" filed of even date herewith by James L. Skinner and J. David Matthews. In FIG. 4, the dried coal product or oxidized dried coal product is charged to a contacting vessel 140 through a line 146 with the contacted coal being recovered through a line or discharge 148. In contact vessel 140, the deactivating fluid is maintained as a finely divided mist by spraying the deactivating fluid into vessel 140 through spray mist injection means 150 which, as shown in FIG. 4, are nozzles 152. Clearly, vessel 140 can be of a variety of configurations, and any reasonable number of mist nozzles 152 can be used. It is, however, necessary that the residence time between the upper end 142 of contacting vessel 140 and the lower end 144 of vessel 140 be sufficient that the coal is intimately contacted with the deactivating fluid as it passes through vessel 140. Deactivating fluid is injected into vessel 140 through lines 158 which supply nozzles 152. Optionally, a diverter 143 may be positioned to disrupt the flow of the coal to facilitate contact with the deactivating fluid.

Figure 5:
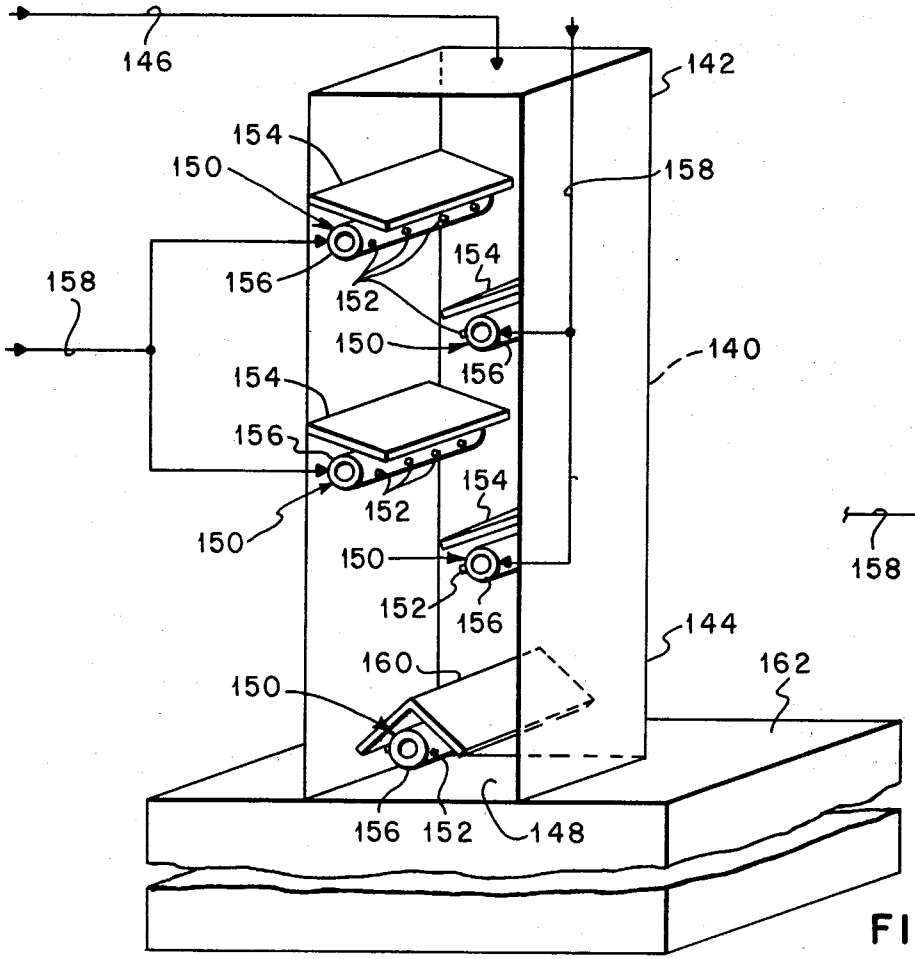

A further embodiment of a suitable contacting vessel is shown in FIG. 5. The contacting vessel shown in FIG. 5 is positioned on a storage hopper 162 and includes on its inner walls a plurality of projections 154, which serve to break up the smooth fall of particulate coal solids through vessel 140 thereby facilitating intimate contact of the particulate solids with the deactivating fluid mist present in vessel 140. Projections 154 may be of substantially any effective shape or size. Mist injection means 150 as shown in FIG. 5 comprise tubes 156 positioned beneath projections 154. Tubes 156 include a plurality of mist injection nozzles 152. Further, a deflector 160 is provided near lower end 144 of vessel 140 to further deflect the stream of particulate coal solids as they are discharged from vessel 140. A tube 156 including mist nozzles 152 is positioned beneath deflector 160.

In the operation of the vessels shown in FIGS. 4 and 5, a particulate coal stream is introduced into the upper portion of the vessels 140 and passes downwardly through vessel 140 by gravity flow in continuous contact with a finely divided mist of a suitable deactivating fluid. The residence time is highly variable depending upon the size of the stream passed through the vessel 140, the presence or absence of projections in vessel 140 and the like. The contact time and amount of mist are adjusted to obtain a desired quantity of deactivating fluid in intimate mixture with the coal.

Some suitable deactivating fluids are selected from the group consisting of virgin vacuum reduced crude oils. Such materials are normally mixed with the dried or dried oxidized coal in quantities from about one-half to about two gallons of material per ton of dried coal, as described in U.S. patent application No. 333,137 entitled "Deactivating Dried Coal with a Special Oil Composition" by Donald K. Wunderlich filed of even date herewith. Preferably, from about one to about one and one-half gallons is used. Such materials have been found to inhibit the reactivity of the dried coal with respect to spontaneous ignition to a high degree.

Other deactivating fluids are disclosed in U.S. Pat. No. 4,201,657 issued May 6, 1980 to Anderson et al and U.S. Pat. No. 4,265,637 issued May 5, 1981 to Anderson, both of which are hereby incorporated in their entirety by reference.

Other suitable materials for use as a deactivating fluid are selected from aqueous solutions of polymeric materials as described in U.S. patent application, Ser. No. 333,146 entitled "Reducing the Tendency of Dried Coal to Spontaneously Ignite" by J. David Matthews filed of even date herewith. The reference to solutions of polymeric materials should be understood to encompass dispersions of polymeric materials and emulsions of polymeric materials.

In the practice of the method shown in FIGS. 1 and 2 which is set forth in U.S. patent application, Ser. No. 333,142 entitled "A Method for Producing a Dried Coal Fuel Having a Reduced Tendency to Spontaneously Ignite From a Low Rank Coal" by Ying Hsiao Li, J. David Matthews, James L. Skinner, Bernard F. Bonnecaze, and Donald K. Wunderlich filed of even date herewith, it may be desirable in some instances that an oxidation step be used, whereas with other coal feed stocks, such a step may not be necessary. In general, it is believed that it will be necessary to dry and cool all low rank coals to produce a desirable dried coal fuel which is not undersirably susceptible to spontaneous ignition. In many instances, it may be necessary to do no more than dry the coal and cool and the resulting dried coal to produce a stable fuel. In other instances, it may be necessary to use a deactivating fluid with the dried coal. In still other instances with more reactive coal, it may be necessary to use drying in combination with oxidation, cooling and/or a deactivating fluid. The selection of the particular process will be dependent to a large extent upon the particular coal feed stock used. Another variable which may affect the choice of the process for a particular low rank coal is the risk involved upon spontaneous ignition. For instance, it may be desirable to over-treat dried coal products which are to be shipped by sea or the like in view of the substantially greater risk of damage upon spontaneous ignition than would be the case for coals which are to be stacked near a coal-consuming facility. A multitude of considerations will affect the particular process chosen; however, it is believed that the particular combination of steps set forth will be found effective in the treatment of substantially any low rank coal to produce a dried fuel product which has a reduced tendency toward spontaneous ignition.

While the invention has been described with respect to a dryer including a grate and a fluidized or semi-fluidized coal drying zone, substantially any effective method for drying particulate solids could be used. For instance, expanded, ebullated, fluidized or semi-fluidized coal drying zones could be used. Other types of drying equipment such as moving grates, slotted grates, rotating drums, revolving screens, spinning grills and the like could be used. In general, such equipment and methods are suitable for either drying or cooling particulate coal.

In the practice of the present method, an improvement is accomplished by the use of water injection in cooler 80. The water is added through a line 106 and a spray system 108 immediately prior to passing the dried coal into cooler 80 or through a spray system 110 which adds the water to the dried coal immediately after injecting the coal into cooler 80. Either or both types of systems may be used. In any event, it is highly desirable that the water be sprayed uniformly over the cool surface. An important limitation, however, is that the amount of water added is only that amount required to achieve the desired cooling of the dried coal by evaporation. The water is very finely sprayed onto the coal, and is controlled to an amount such that the added water is substantially completely evaporated from the coal prior to discharge of the cooled dried coal via line 96. In many areas of the country, relatively dry air is available for use in such cooling applications. For instance, in Wyoming, a typical summer air condition is about 90° F. (32° C.) dry bulb and about 65° F. (18° C.) wet bulb temperature. Such air is very suitable for use in the cooler as described. While substantially any cooling gas could be used, the gas used will normally be air. Air is injected in an amount sufficient to fluidize or semi-fluidize the dried coal moving along grate 82 and in an amount sufficient to prevent the leaking of water through grate 82. The flow is further controlled to a level such that the velocity above the coal on grate 82 is insufficient to entrain any liquid water in the exhaust stream flowing to cyclone 90. Desirably, the air flow is at a rate such that the air leaving the cooler is no more than about 85 percent saturated with water. A preferred range is from about 50 to about 85 percent saturation. Such determinations are readily within the skill of those in the art and need not be discussed in detail since the flow rates will vary depending upon the amount of cooling required.

In a further variation, the water may, in some instances, be introduced as a fine mist beneath grate 82 via a spray system 109 and carried into the coal moving along grate 82 with the cooling gas or sprayed directly into the coal via a spray system 111. In such instances, similar considerations apply, and only that amount of water is added which is required to accomplish the desired temperature reduction in the coal on grate 82. The use of water as set forth above results in a reduced horsepower requirement for the blowers (not shown) for cooler 80 and in a reduced air flow. The use of water as set forth herein would at first appear undesirable and impractical since the coal has just been dried, and it would appear to be an exercise in futility to reapply water to the dried coal. Surprisingly, it has been found that the use of relatively small amounts of water as required for the evaporative cooling does not result in the retention of the water in the coal, but rather the water is readily removed by evaporation with the net result being a cooling of the coal particles without the absorption of any substantial portion of the water added in cooler 80. While Applicant does not wish to be bound by any particular theory, it appears that when water contacting for short times is used that the water does not diffuse back into the coal, but rather is readily evaporated to cool the surface. Accordingly, the use of the improvement of the present invention, i.e., the addition of water to the dried coal in cooler 80, has resulted in a substantial reduction in the volume of air required and an increase in the efficiency of operation of cooler 80. Such volume reductions result in substantial reductions in the power requirements to cooler 80. In some instances, the power requirements could be reduced by up to 50 percent of the power required for drying with air alone. Lower temperatures in the cooled coal can be achieved in a given cooling zone where the air volumes are limited by use of evaporative cooling. Typical residence times in cooler 80 may be of the order of two minutes, and it is highly desirable that the water be applied in the first one minute of residence time in cooler 80, so that the water may be substantially completely evaporated before discharging the dried coal product through line 96.

Typically, amounts of water from about 0.3 to about 0.8 lbs. of water per ton of dried coal per °F. of desired temperature reduction are suitable.

Having thus described the invention by reference to certain of its preferred embodiments, it is respectfully submitted that the embodiments disclosed are illustrative rather than limiting in nature, and that many variations and modifications are possible within the scope of the present invention. Many such variations and modifications may appear obvious and desirable based upon the foregoing description of preferred embodiments and the following example:

EXAMPLE 150 tons per hour of hot (200° F.) dried coal (5 weight percent water) is to be cooled to 90° F. (32° C.) using direct evaporative cooling. Ambient air at 80° F. (26.5° C.) and 30% relative humidity is available, and water is available at 80° F. (26.5° C.) The water is sprayed onto the coal, and air is passed upwardly through the coal. Air is used at the rate of 600,000 lbs. of air per hour and water is sprayed onto the dried coal at the rate of 8,023 lbs. per hour. The resulting exhaust stream is at 90° F. (32° C.) and is 68% saturated with water. The coal is cooled to 90° F. (32° C.). A residence time of two minutes is suitable. When a slotted grate conveyer is used, a pressure drop of 12 inches of water across the grate is considered suitable. At this pressure drop, the flow rate through the slots is desirably about 300 feet per second to achieve the desired pressure drop and prevent the passage of water through the slots. In the example given, the slot area required is 8.7 $ft.^2$. A bed depth of 4 ft. is used in the example, and it is assumed that the bed is 50% expanded or fluidized.

The area in the exhaust zone in cooler 80 above the cooler grate may need to be larger than grate 82 in some instances to prevent the entrainment of water in the exhaust gas.

Having thus described the present invention, I claim:

1. In a process for producing a dried particulate coal fuel having a reduced tendency to spontaneously ignite from a low rank coal selected from the group consisting of subbituminous, lignite and brown coals, said method consisting essentially of:

a. charging said particulate low rank coal to a coal drying zone;

b. drying said coal in said coal drying zone to produce a dried coal;

c. Recovering said dried coal from said coal drying zone;

d. Cooling said dried coal in a coal cooling zone to a temperature below about 100° F. by contacting said dried coal with a cooling gas to produce a dried cooled coal;

the improvement comprising; spraying a controlled quantity of water onto said dried coal in said coal drying zone, said water being sprayed onto said dried coal in an amount sufficient to remove a desired quantity of heat from said dried coal upon evaporation of said water and substantially completely evaporating said water from said coal in said coal cooling zone.

2. The improvement of claim 1 wherein said coal is a sub-bituminous coal which is dried to a water content of less than about 15 weight percent water in said coal drying zone.

3. The improvement of claim 1 wherein said coal is a lignite coal which is dried to a water content of less than about 20 weight percent water in said coal drying zone.

4. The improvement of claim 1 wherein said coal is a brown coal which is dried to a water content of less than about 30 weight percent water in said coal drying zone.

5. The improvement of claim 1 wherein said cooling gas is flowed upwardly through said dried coal in said coal cooling zone at a velocity sufficient to prevent the passage of said water through said second coal support means, but insufficient to entrain liquid water in the exhaust gas stream above said dried coal.

6. The improvement of claim 5 wherein said cooling gas comprises air.

7. The improvement of claim 1 wherein at least a portion of said water is sprayed onto said dried coal prior to charging said dried coal to said coal cooling zone.

8. The improvement of claim 1 wherein at least a portion of said water is sprayed onto said dried coal after charging said dried coal to said coal cooling zone.

9. The improvement of claim 1 wherein said dried coal is oxidized prior to cooling said dried coal.

* * * * *